US008979409B2

(12) United States Patent
Ulrich et al.

(10) Patent No.: US 8,979,409 B2
(45) Date of Patent: Mar. 17, 2015

(54) DEVICE FOR STORING AND SELECTIVELY DISPENSING DIFFERENT PRODUCTS

(76) Inventors: Kevin Ulrich, West Islip, NY (US); James Bordonaro, Bay Shore, NY (US)

( * ) Notice: Subject to any disclaimer, the term of this patent is extended or adjusted under 35 U.S.C. 154(b) by 548 days.

(21) Appl. No.: 13/287,277

(22) Filed: Nov. 2, 2011

(65) Prior Publication Data

US 2013/0108350 A1 May 2, 2013

(51) Int. Cl.

| | |
|---|---|
| ***A46B 11/00*** | (2006.01) |
| ***A45D 33/02*** | (2006.01) |
| ***A45D 34/06*** | (2006.01) |
| *A45D 33/26* | (2006.01) |
| *A45D 34/04* | (2006.01) |
| *A45D 40/24* | (2006.01) |
| *A45D 34/00* | (2006.01) |

(52) U.S. Cl.

CPC ..... *A45D 33/02* (2013.01); *A45D 34/06* (2013.01); *A45D 33/26* (2013.01); *A45D 34/04* (2013.01); *A45D 34/042* (2013.01); *A45D 40/24* (2013.01); *A45D 2034/005* (2013.01); *A45D 2200/1009* (2013.01)

USPC ..... 401/23; 401/17; 401/18; 401/21; 132/294; 132/314

(58) Field of Classification Search

CPC ... A45D 34/00; A45D 34/3406; A45D 40/24; A45D 40/18; A45D 33/22; A45D 33/24; A45D 33/26; A45D 33/28

USPC ..... 401/16, 17, 18, 21, 24–27, 23; 132/294–297, 314

See application file for complete search history.

(56) References Cited

U.S. PATENT DOCUMENTS

| | | | | |
|---|---|---|---|---|
| 2,215,161 | A * | 9/1940 | Sapery | 132/314 |
| 2,396,932 | A * | 3/1946 | Slaton et al. | 132/314 |
| 4,039,435 | A | 8/1977 | Narva | |
| 4,159,066 | A | 6/1979 | Silver | |
| D313,181 | S | 12/1990 | Pettengill | |
| 4,974,727 | A | 12/1990 | Karasin et al. | |
| D315,496 | S | 3/1991 | Pettengill | |
| 5,020,694 | A | 6/1991 | Pettengill | |
| 5,897,262 | A * | 4/1999 | Bratby-Carey | 401/18 |
| 5,931,169 | A | 8/1999 | Kervoalen | |
| 6,129,089 | A | 10/2000 | Yuhura | |
| 6,412,640 | B1 | 7/2002 | Destanque et al. | |
| 6,526,991 | B2 | 3/2003 | Bodwalk | |
| 6,540,084 | B2 | 4/2003 | Silvers | |
| 6,568,529 | B2 | 5/2003 | McMurrey | |
| 6,601,737 | B1 | 8/2003 | Sandler | |
| 6,722,498 | B2 | 4/2004 | Westfield et al. | |
| 6,945,723 | B1 | 9/2005 | Gueret | |
| 7,055,686 | B2 | 6/2006 | De-Vries | |
| D535,196 | S | 1/2007 | Ueda et al. | |
| 7,226,227 | B2 * | 6/2007 | Gueret | 401/18 |
| D601,426 | S | 10/2009 | Darr et al. | |

* cited by examiner

*Primary Examiner* — David Walczak
(74) *Attorney, Agent, or Firm* — Dilworth & Barrese, LLP

(57) ABSTRACT

A device for storing and dispensing different product possesses at least two interlocking product dispenser units each possessing a product dispensing outlet through which stored product may be selectively dispensed.

15 Claims, 8 Drawing Sheets

DEVICE FOR STORING AND SELECTIVELY DISPENSING DIFFERENT PRODUCTS

BACKGROUND OF THE INVENTION

The present invention relates to containers, in particular, to containers featuring multiple product storage enclosures from which an individual product is selectively dispensable.

Containers possessing two or more enclosures, or compartments, for storing and selectively dispensing one of several products are known.

However, there still exists a need for a device possessing individual product dispensers that are releasably locked to each other.

BRIEF SUMMARY OF THE INVENTION

In accordance with the present invention, there is provided a device for storing and selectively dispensing different products which comprises:

a) a first product dispenser for storing and dispensing a first product, the first product dispenser having a first end portion, a second end portion, a wall extending therebetween defining a fixed or detachable first enclosure and at least one outlet through which first product stored within the first enclosure is dispensable; and, b) a second product dispenser for storing and dispensing a second product, the second product dispenser having a first end portion, a second end portion and a wall extending therebetween defining a fixed or detachable second enclosure and at least one outlet through which second product stored within the second enclosure is dispensable, the first end portion of the second product dispenser being configured for releasable locking engagement with the second end portion of the first product dispenser and having a cavity therein configured to receive the second end portion of the first product dispenser when the second end portion of the first product dispenser is in locked engagement with the first end portion of the second product dispenser.

The foregoing device can be provided in a large variety of dimensions, e.g., ranging from palm-sized to those approximating or even exceeding the dimensions of a ladies handbag or small item of hand-carried luggage.

Moreover, the device of this invention can be made to assume any of a large variety of configurations, particularly those providing an aesthetic visual appearance such as the embodiments described in the drawings, infra, while retaining the mechanical features that give it its distinctive utility as a dispensing container for a variety of different products.

BRIEF DESCRIPTION OF THE SEVERAL VIEWS OF THE DRAWINGS

In the accompanying drawings, like reference numerals designate like structural elements throughout the figures thereof and wherein.

DETAILED DESCRIPTION OF THE INVENTION

Figure 1A:
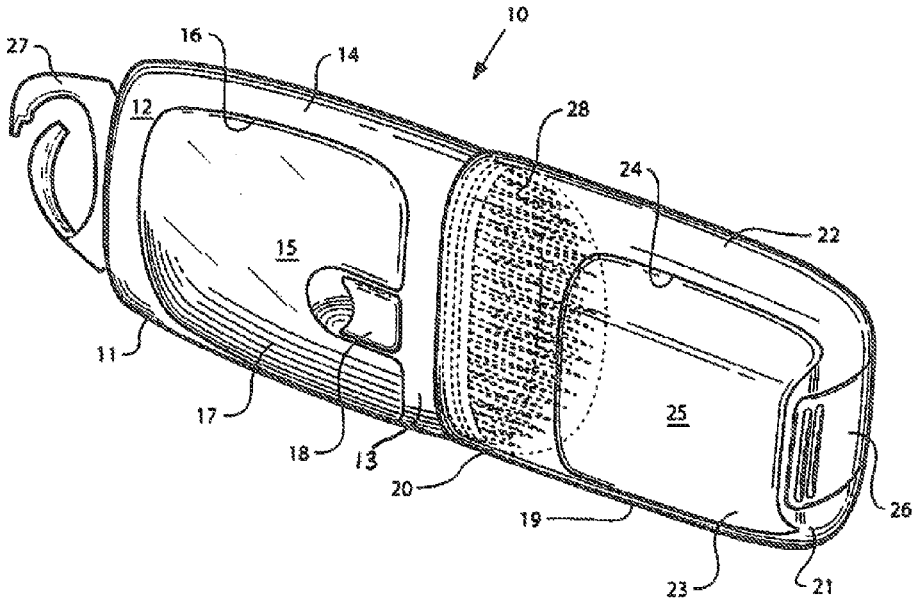
FIGS. 1A and 1B are isometric views of embodiments in accordance with the invention illustrating individual product dispensers in locked engagement with each other.

Referring to FIG. 1A, elongated container device 10 of generally oval cross section as viewed from its arbitrarily designated right side includes a first product dispenser 11 possessing first and second end portions 12 and 13, respectively, a wall 14 extending therebetween and a detachable first enclosure, or replaceable first cartridge, 15 occupying enclosure-accommodating recess 16 defined within the first dispenser such that wall 17 of the enclosure together with wall 14 of the dispenser forms a substantially continuous smooth-walled exterior. First product dispenser 11 also features a thumb-actuated release 18 for facilitating the removal of enclosure 15 from its recess 16 within product dispenser 11.

Container device 10 further includes a second product dispenser 19 possessing first and second end portions 20 and 21, respectively, a wall 22 extending therebetween and a detachable second enclosure, or replaceable second cartridge, 23 occupying recess 24 defined within the second dispenser such that wall 25 of the enclosure together with wall 22 of dispenser 19 forms a substantially continuous smooth-walled exterior.

In the configuration of the device shown in FIG. 1A, second end portion 13 of first product dispenser 11 is shown in releasably locked engagement with first end portion 20 of second product dispenser 19. Second end portion 21 of product dispenser 19 possesses a hinged closure member 26 for sealing the outlet of the second enclosure. An optional gripping or attachment component, e.g., carabiner 27, is connected to first end portion 12 of first product dispenser 11.

Shown in phantom in FIG. 1A is an arcuate arrangement of optional bristle elements 28 associated with one or more restricted outlets at second end portion 13 of first product dispenser 11. As illustrated in greater detail in FIGS. 4A and 4B, infra, bristle elements 28 occupy a complementary arcuate cavity defined within first end portion 20 of second product dispenser 19.

Figure 1B:
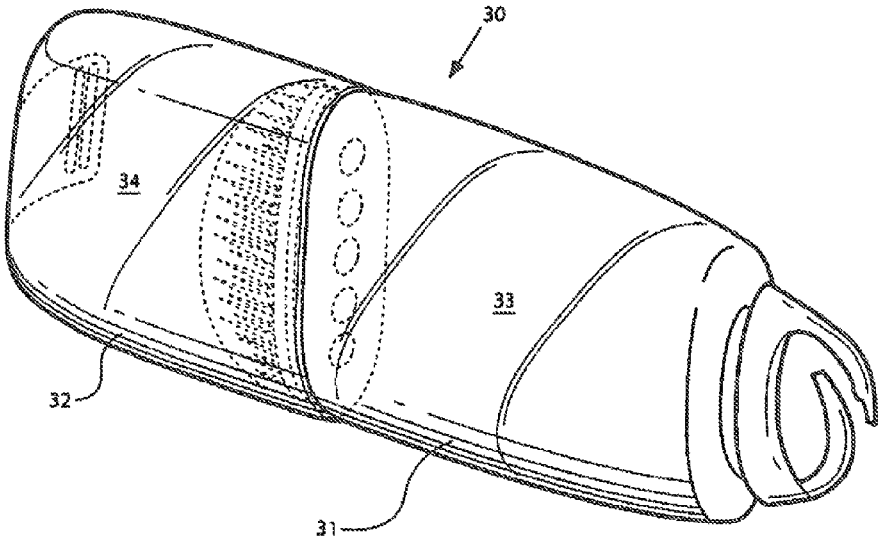

The embodiment of elongated container device 30 shown in FIG. 1B is similar to that shown in FIG. 1A except that the device is viewed from its left side and first and second product dispensers 31 and 32 possess fixed enclosures 33 and 34, respectively.

Each product dispenser is adapted for the storage and dispensing of a single product from either 9 fixed or detachable closure. In the embodiment of the device of FIG. 1A, detachable first enclosure 15 can contain a powdery product, e.g., talcum powder, which upon being dispensed therefrom is to a large extent deposited upon its associated product applicator, i.e., bristle elements 28, from which the powder may then be applied to the skin. Once emptied of powder, the enclosure 15 can be removed from its recess within first product dispenser 11 and a full replacement enclosure, or cartridge, inserted in its place. Similarly, detachable second enclosure 23 once emptied of its contents, e.g., an antimicrobial liquid, cosmetic lotion, cream, sunscreen, medicated ointment, etc., can be removed from its recess 24 within second product dispenser 19 and replaced with a fresh cartridge.

Figure 2A:
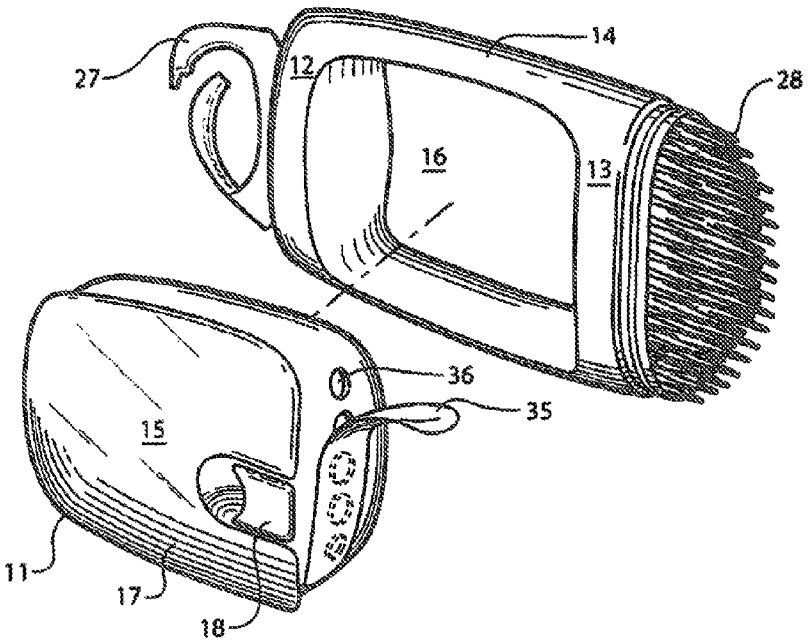
FIGS. 2A and 2B are isometric views of the device of FIG. 1A illustrating individual product dispensers disengaged from each other and each product enclosure separated from its recess within its respective product dispenser.

FIG. 2A illustrates first product dispenser 11 of FIG. 1A with its detachable enclosure 15 shown separated from its recess 16. First enclosure 15 can be inserted into recess 16 from either the left or the right side of product dispenser 11 or from one side only where the opposite side of the dispenser is defined by a continuous wall. Peelable tape 35 provides a temporary closure for outlets 36 of enclosure 15 and may be removed at the time when enclosure 15 is inserted into its recess.

Figure 2B:
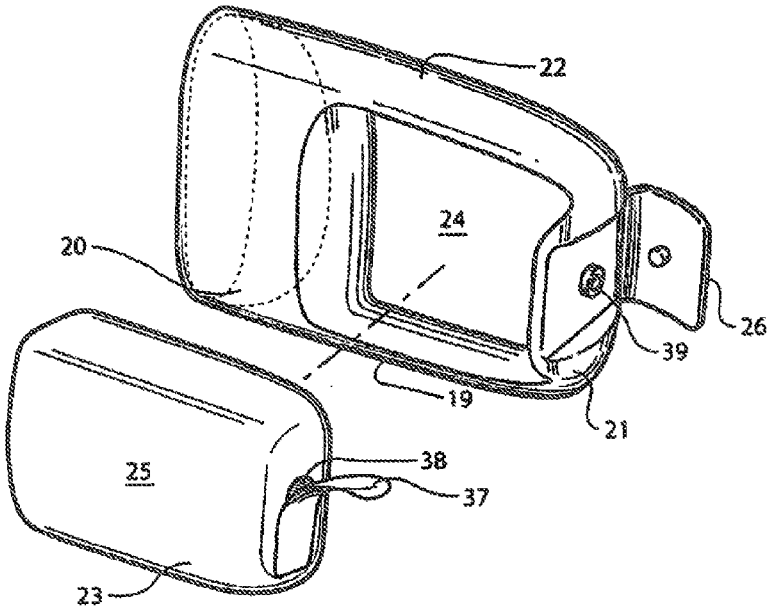

FIG. 2B illustrates second product dispenser 19 with its detachable second enclosure 23 separated from recess 24. Detachable second enclosure 23 can be inserted into its recess 24 from either the left or the right side of second product dispenser 19 or from one side only where the opposite side of the dispenser is defined by a continuous wall. Peelable tape 37 provides a temporary closure for outlet 38 of enclosure 23 and may be removed at the time the enclosure 23 is inserted into its recess. Hinged closure member 26 at second end 21 of the second product dispenser 19 is shown in its open position to reveal outlet 39 which is aligned with outlet 38 of enclosure 23 to provide a substantially continuous conduit for dispensed product.

Figure 3A:
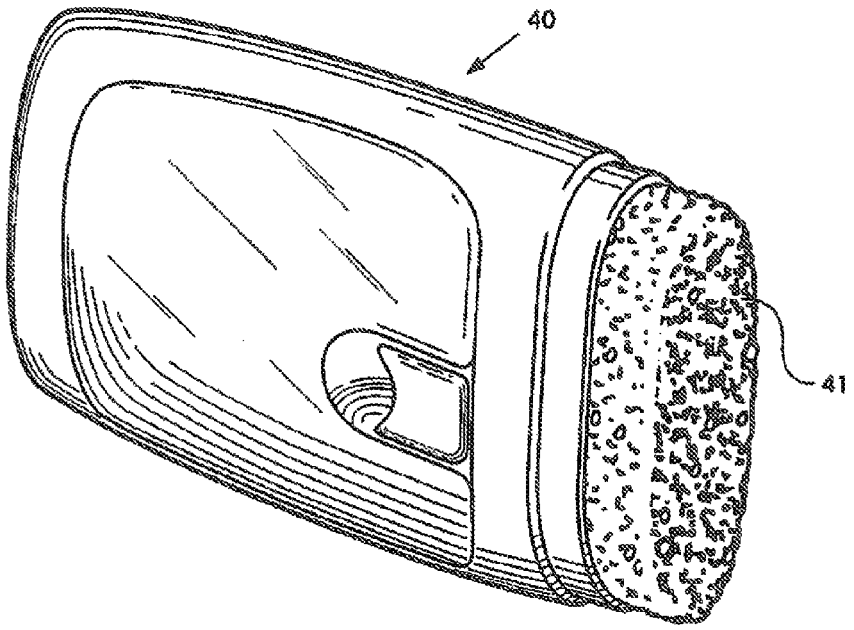
FIGS. 3A and 3B are isometric views of product dispensers respectively illustrating sponge-type and roller-type product applicators.
Figure 3B:
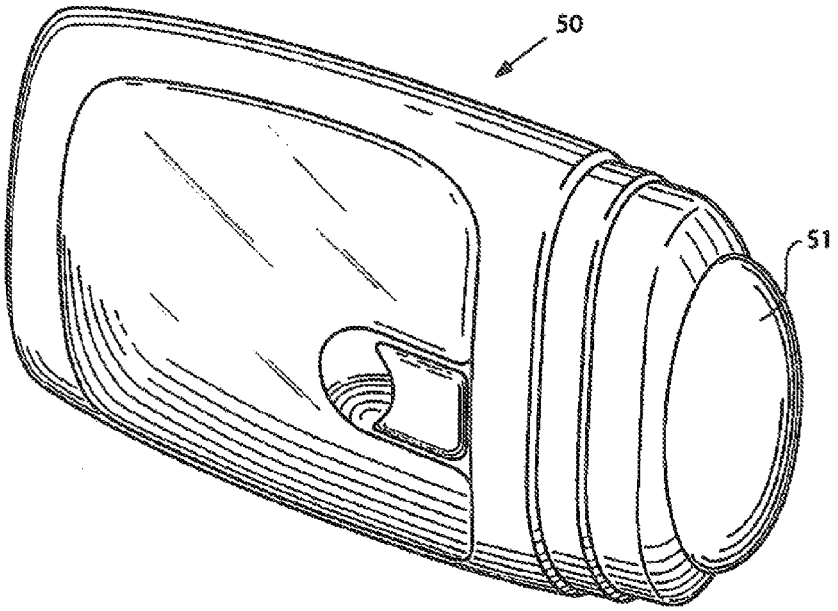

FIGS. 3A and 3B illustrate first product dispensers 40 and 50 having, respectively, sponge applicator 41 and roller applicator 51 for receiving product, e.g., liquid, gel, etc., dispensed from detachable first enclosure 15, and applying the dispensed product to a surface, e.g., skin.

Figure 4A:
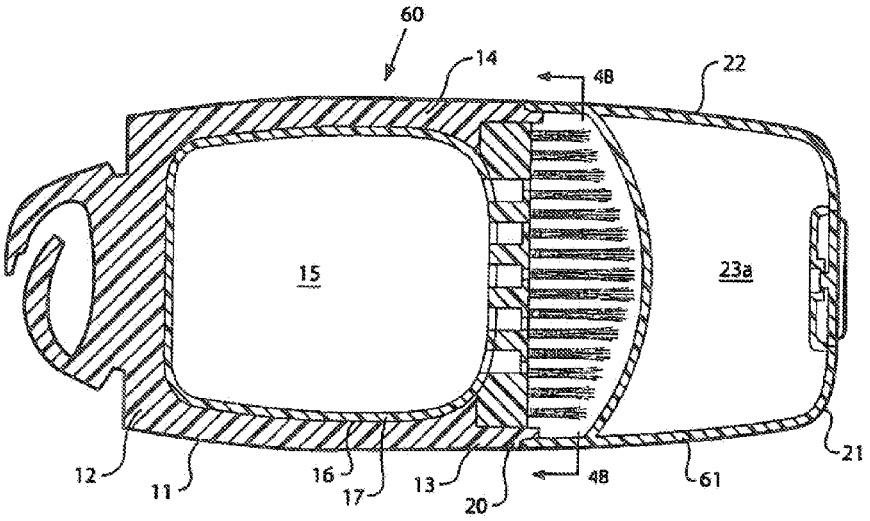
FIG. 4A is a sectional plan view in cross section of a device of the invention in the locked configuration and illustrating a first product dispenser with a detachable first enclosure and brush-type product applicator and a second product dispenser having a fixed second enclosure.

FIG. 4A illustrates in cross section plan view modification 60 of the embodiment of FIG. 1A wherein in place of detachable second enclosure 23 of the latter, the former possesses a fixed second enclosure 23*a* as the product-storing portion of second product dispenser 61.

Figure 4B:
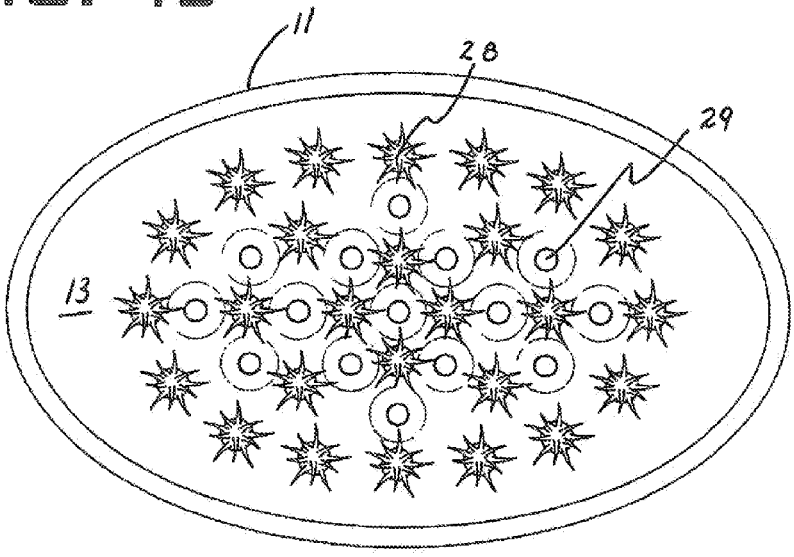
FIG. 4B is a plan view of the device of FIG. 4A taken through cross-sectional lines 4B thereof and illustrating the arrangement of powder-dispensing outlets and associated brush applicator elements.

In the plan view of the device of FIG. 4A taken through cross sectional lines 4B thereof, there is illustrated in FIG. 4B an arrangement of bristle elements 28 and associated powder-discharging outlets, or orifices, 29 positioned at second end portion 13 of first product dispenser 11.

Figure 5A:
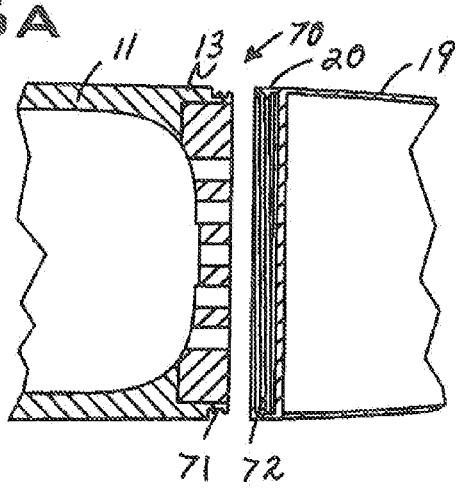
FIG. 5A is a cutaway plan view in cross section of another embodiment of device in accordance with the invention illustrating threads on the mutually engageable ends of the first and second product dispensers.

FIG. 5A illustrates a cutaway plan view in cross section of an embodiment 70 of the invention wherein detached second end portion 13 of first product dispenser 11 and first end portion 20 of detached second product dispenser 19 are both of circular cross section. External threading 71 on first end portion 13 and internal threading 72 on first end portion 20 provide for locking engagement of product dispensers 11 and 19.

Figure 5B:
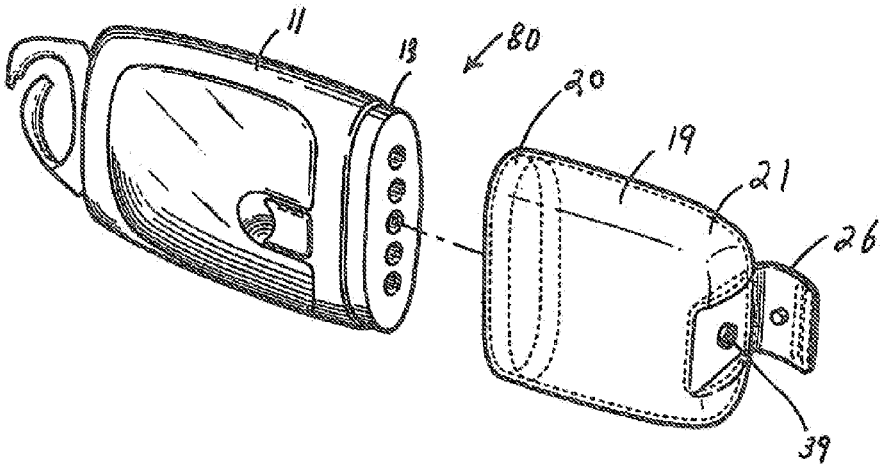
FIG. 5B is an exploded isometric view of a device of the invention illustrating the snap-fit engagement of the mutually engageable ends of the first and second product dispensers.

FIG. 5B is an exploded isometric view of an embodiment 80 of the device of the invention in which first end portion 13 of first product dispenser 11 and second end portion 20 of second product dispensing 19 are generally ovoid in cross section allowing for friction fit-locking engagement, e.g., as shown in the embodiment of FIG. 4A.

Figure 5C:
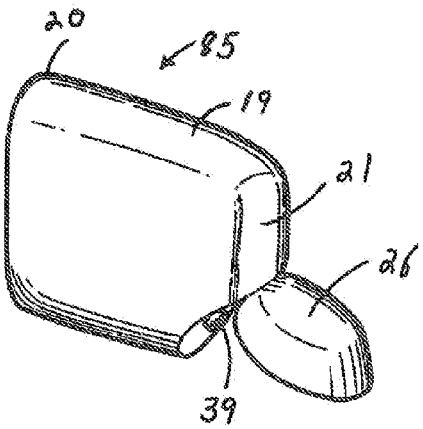
FIG. 5C is an isometric view of a second product dispenser having a hinged closure for its single product dispensing outlet.

FIG. 5C illustrates another embodiment 85 of second product dispenser 19 wherein offset hinged closure member 26 positioned at second end portion 21 of second product dispenser 19, shown in the open position, provides sealing of outlet 39.

Figure 6A:
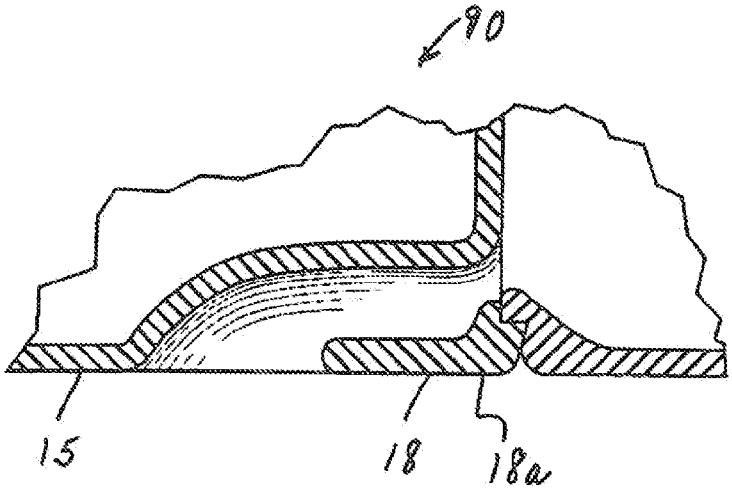
FIGS. 6A and 6B are cutaway sectional views of a pull tab for facilitating the separation of a detachable enclosure from its recess within the product dispenser.
Figure 6B:
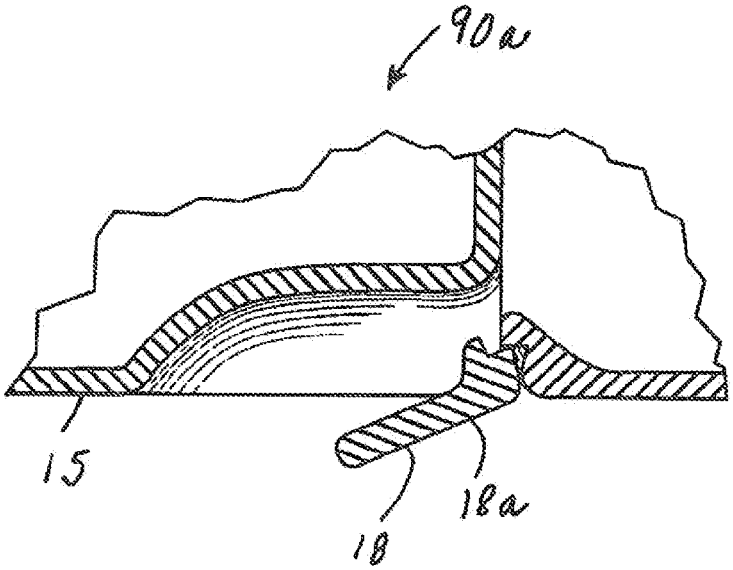

FIGS. 6A and 6B illustrate cutaway views 90 and 90*a* of pull tab 18 shown in the embodiments illustrated in FIGS. 3B, 5B, 7A, 7B and 8A. Downward (outward) biased movement of pull tab 18*a* facilitates detachment of detachable first enclosure 15 from its recess in the first product dispenser. In place of pull tab 18, there may be provided a thumb actuated snap lock/release mechanism of known or conventional construction for facilitating alternate locking engagement and release of detachable first enclosure 15 from within its recess in the product dispenser.

Figure 7A:
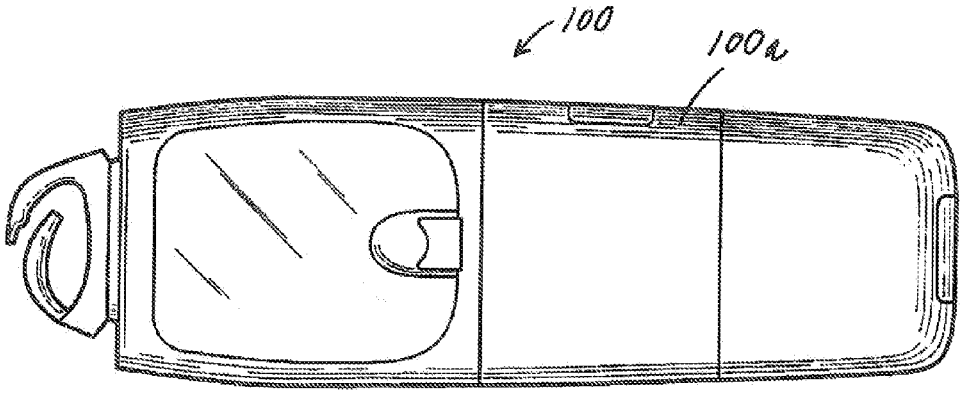
FIGS. 7A and 7B are plan views of three-product dispenser embodiments of the device herein; and, FIGS. 8A and 8B are isometric views of the detachable first enclosure and detachable second enclosure, respectively, of FIG. 1A illustrating the hand-exerted bellows-like or compressive action which results in discharge of product therefrom.
Figure 7B:
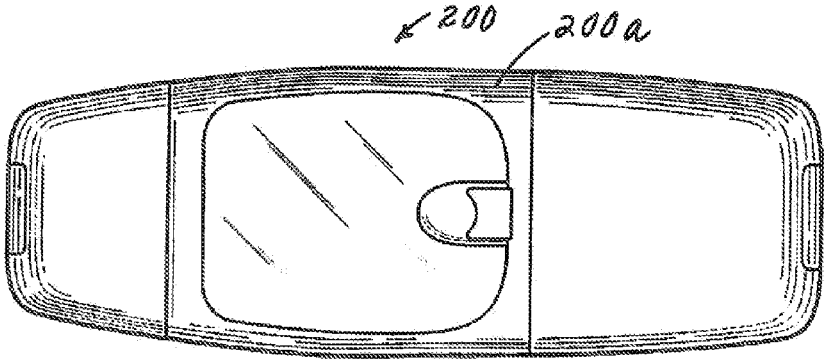

FIGS. 7A and 7B illustrating 3-product embodiments of the device of the invention and possess a third product dispenser 100*a* and 200*a*, respectively, positioned between the other two. Numerous other arrangements, including the positioning of product dispenser outlets, may be provided as desired.

Figure 8A:
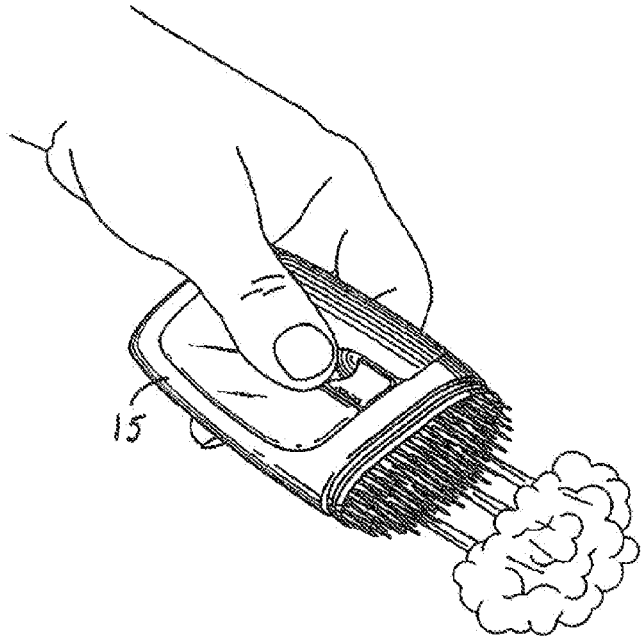
Figure 8B:
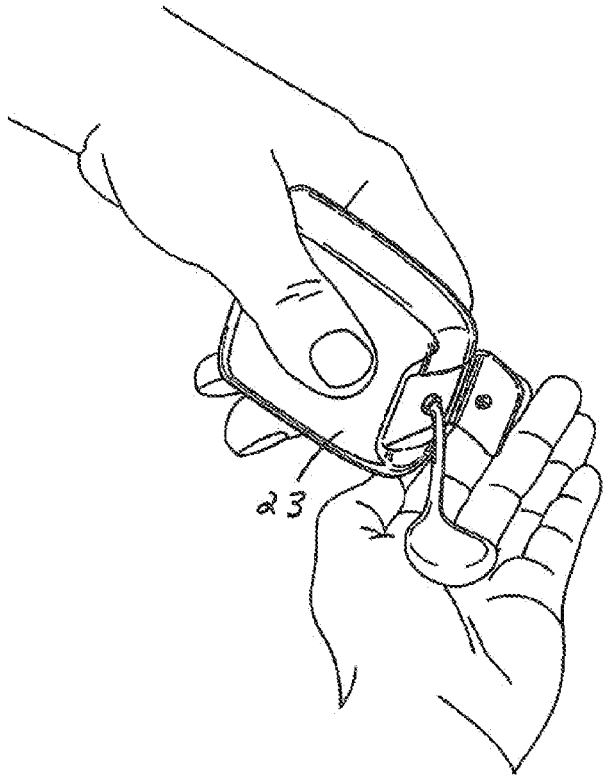

FIGS. 8A and 8B illustrate the discharge of product from detachable first and second enclosures 15 and 23 shown in FIGS. 2A and 2B, respectively. In the case of detachable first enclosure 15 in FIG. 8A, a cosmetic powder, e.g., talcum powder, is dispensed therefrom by a bellows-like, or compressing, action exerted against a lateral wall or walls 17 of the enclosure. Similarly, in the case of detachable second enclosure 23 in FIG. 8B a bellows-like or compressing, action exerted against one or both walls 22 cause a fluid product, e.g., an antimicrobial liquid, to be dispensed therefrom.

Other embodiments of the invention will be apparent to those skilled in the art from a consideration of this specification or practice of the invention disclosed herein. It is intended that the specification and examples be considered as exemplary only, with the true scope and spirit of the invention being defined by the following claims.

What is claimed is:

1. A device for storing and selectively dispensing different products which comprises:

a) a first product dispenser for storing and dispensing a first product, the first product dispenser having a first end portion, a second end portion, a wall extending therebetween defining a detachable first enclosure and at least one outlet of the first enclosure for enabling the first product stored within the first enclosure to be dispensable; and, b) a second product dispenser for storing and dispensing a second product, the second product dispenser having a first end portion, a second end portion and a wall extending therebetween defining a detachable second enclosure and at least one outlet of the second enclosure for enabling the second product stored within the second enclosure to be dispensable, the first end portion of the second product dispenser being configured for releasable locking engagement with the second end portion of the first product dispenser and having a cavity therein configured to receive the second end portion of the first product dispenser when the second end portion of the first product dispenser is in locked engagement with the first end portion of the second product dispenser;

wherein the detachable first enclosure and/or the detachable second enclosure being detachably received within an enclosure-accommodating recess of the product dispenser with a portion of the wall of the enclosure constituting a portion of the wall of the product dispenser.

2. The device of claim 1 presenting a substantially smooth appearance extending from the first end portion of the first product dispenser to the second end portion of the second product dispenser and being substantially symmetrical along its longitudinal axis when the first and second product dispensers are in locked engagement.

3. The device of claim 2 further comprising a third product dispenser for storing and dispensing a third product, the third product dispenser being positioned between the first end portion of the first product dispenser and the second end portion of the second product dispenser.

4. The device of claim 1 wherein the outlet of the first and/or second enclosure is a plurality of outlets.

5. The device of claim 1 wherein the at least one outlet of the first enclosure is at the second end portion of the first product dispenser for enabling the cavity of the first end portion of the second product dispenser to provide a closure for the outlet of the first enclosure when the first end portion of the second product dispenser is in locked engagement with the second end portion of the first product dispenser.

6. The device of claim 1 wherein the at least one outlet of the second enclosure is at the second end portion of the second product dispenser, the outlet of the second enclosure including a closure therefor.

7. The device of claim 6 wherein the closure is a hinged closure.

8. The device of claim 1 wherein the at least one outlet of the first enclosure is at the second end portion of the first product dispenser for enabling product to pass through the outlet of the first enclosure that is directable to, and applicable from, an associated product applicator.

9. The device of claim 8 wherein the product applicator is a brush, sponge or roller.

10. The device of claim 1 wherein the at least one outlet of the second enclosure is at the second end portion of the second product dispenser.

11. The device of claim 10 wherein the device is adapted to enabling product to pass through the outlet of the first enclosure in the first dispenser that is directable to, and applicable from, an associated product applicator.

12. The device of claim 11 wherein the product applicator is a brush, sponge or roller.

13. The device of claim 1 wherein releasable locking engagement of the second end portion of the first product dispenser with the first end portion of the second product dispenser is provided by friction fit.

14. The device of claim 1 wherein at least one detachable enclosure has finger activated-release to facilitate detachment of the enclosure from its recess.

15. The device of claim 1 wherein the wall of the first and/or second enclosure is flexible such that upon flexing, a product-dispensing action is provided.

* * * * *